United States Patent [19]

Wech

[11] 4,077,306

[45] Mar. 7, 1978

[54] BAG MACHINE CYCLE INTERRUPT

[75] Inventor: Robert J. Wech, Green Bay, Wis.

[73] Assignee: FMC Corporation, San Jose, Calif.

[21] Appl. No.: 734,703

[22] Filed: Oct. 21, 1976

[51] Int. Cl.[2] ..... B31B 1/10

[52] U.S. Cl. ..... 93/8 R; 93/33 H; 226/143

[58] Field of Search ..... 93/33 H, 8 R, 14–18; 156/515; 226/143, 108, 117

[56] References Cited

U.S. PATENT DOCUMENTS

| | | | |
|---|---|---|---|
| 3,541,929 | 11/1970 | Crawford et al. | 93/33 H |
| 3,813,998 | 6/1974 | Lotto | 93/33 H |
| 3,884,129 | 5/1975 | Monahan | 93/33 H X |
| 4,003,298 | 1/1977 | Schott, Jr. | 93/33 H |

*Primary Examiner*—James F. Coan

*Attorney, Agent, or Firm*—L. J. Pizzanelli; C. E. Tripp

[57] ABSTRACT

This application discloses an apparatus for preventing heat damage to thermoplastic web material being converted to produce bags. After a selected number of bags have been made, the web feeding rolls are automatically stopped for a short period, which may be for one or more machine cycles or stopped for an indeterminate period on command of the operator, to allow removal or transfer of a completed stack of bags. When web movement is stopped, the web feeding rolls that are driven by a belt, are rotated in a direction opposite to the feed direction to withdraw the leading edge of the web from the plane in which the heated seal bar reciprocates. Withdrawing of the web occurs by applying additional tension to that reach of the belt which will effect reverse rotation of the feeding rolls. Such additional tension is created by freely rotating pulleys mounted on a plate oscillated by an actuator.

11 Claims, 3 Drawing Figures

BAG MACHINE CYCLE INTERRUPT

BACKGROUND OF THE INVENTION

The disclosure of the invention relates to subject matter contained in U.S. Pat. Nos. 3,663,338, 3,586,142 and 3,541,929 and Patent Application Serial Nos. 198,282, filed Nov. 12, 1971, and 382,607 filed July 25, 1973. All patent documents are assigned to the assignee of the present application and their disclosures, by reference thereto, are incorporated herein.

Of the above noted prior art that which is deemed most relevant to the present application is U.S. Pat. No. 3,541,929. Reference thereto will reveal that it discloses controls and mechanisms operated thereby for interrupting the bag producing function of a thermo-plastic bag making machine. Specifically, the system includes a pair of web feeding rolls, sometimes and more usually referred to as draw rolls, between which a web of thermo-plastic material is disposed. The draw rolls are connected to and driven by a shaft mounting a clutch and a brake which are sequentially energized and de-energized to impart intermittent rotation to the draw rolls. The period of time allocated for draw roll rotation determines, with respect to side weld bags, the width of the bag and, with respect to bottom weld bags, the length of the bag. At the time that the draw rolls are momentarily stopped, a reciprocating heated seal bar descends to sever and seal the web material and in doing so establishes pressure contact with an underlying platen or seal roll. If the machine is arranged to produce bottom weld bags the seal roll is replaced by a rigid stationary heated bar since the seal requirement for bottom weld bags oftentimes differ substantially from side weld bags. All known universal bag machines include, as part of their control systems, a cycle counting device which may be set to produce a certain number of bags in succession. After the pre-determined number of bags have been made, the cycle counting mechanism conditions the circuit to automatically interrupt draw roll operation in order to prevent feeding of the web. Simultaneously with the interruption of web feed the seal bar is restrained or prevented from making contact with the web.

One of the primary objectives in present day bag machine design is to minimize the time required to effect interruption of the draw roll operation and disabling the seal bar so that it does not make contact with the leading edge of the arrested web. An acceptable time to perform these functions is one bag making cycle. Known machinery, including machinery made in accordance with the above identified patents and patent applications, operates reasonably well up to about 200 bag machine cycles per minute. Requirements for higher speeds, for example 300 bags per minute, renders bag machine interrupt systems, constructed in accordance with the above mentioned prior art, inadequate since the time constants of the operating controls, such as pneumatic cylinders and the inertia of certain machine elements, require more than 1/5 of a second (at 300 bags per min. 5 bags are produced per second) to effect interruption of the draw rolls and the seal bar.

SUMMARY OF THE INVENTION

Accordingly, it is a primary feature of the present invention to provide a web interrupting system that positions the leading edge of the arrested web so that contact with the reciprocating seal bar does not occur.

The preferred structural arrangement for achieving this objective includes opposed drive belt tensioning devices, such as rollers, which are freely rotatably mounted on an oscillatable plate which in one position fulfills the role of a normal belt tensioning mechanism and in another position, the draw roll reversal position, applies tension to the driving belt such that the draw rolls are reversed to a limited extent but sufficient to retract the feeding edge of the web away from the plane of actuation of the heated seal bar.

DESCRIPTION OF THE PREFERRED EMBODIMENT

Figure 1:
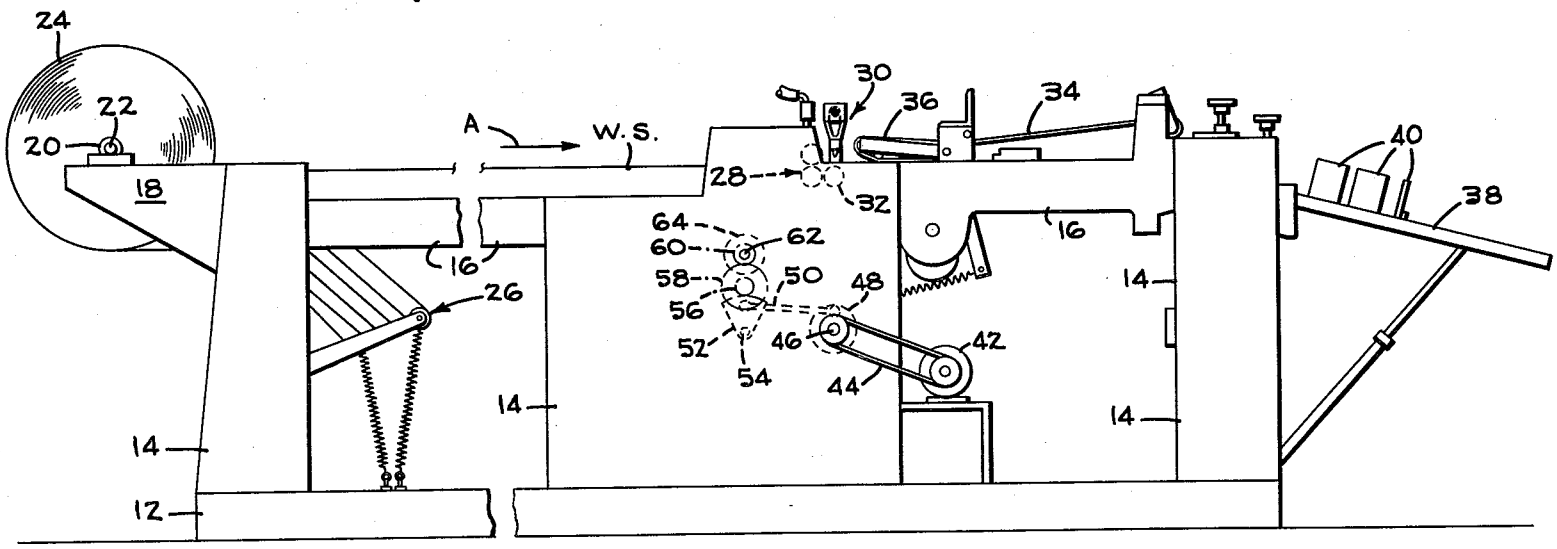
FIG. 1 is the side elevation of a typical bag machine incorporating the subject matter of the present invention.

A bag machine incorporating the novel features of the present invention is shown in FIG. 1 and is generally indicated by the numeral 10. The frame of the bag machine includes a base member 12 on which are fixed upwardly extending laterally spaced plates 14 interconnected by cross members (not shown) and longitudinal rails and braces 16. On one end of the machine, laterally spaced rearwardly extending supports 18, mounting bearing blocks or any suitable posts 20, support a transverse shaft 22 carrying a roll of thermosplastic web material 24. To maintain substantially constant web tension, a dancer system 26, operating to accumulate and pay-out web in response to the intermittent rotation of hereinafter to be identified draw rolls, is provided. The web, moving in the direction of the arrow A, is fed between draw rolls 28 which are intermittently rotated to feed a portion of the web strip W.S. below a vertically reciprocating seal bar structure 30 operating to make momentary pressure contact with an underlying seal roll 32 and thereby effect severing and sealing of the web material. During the time the seal bar structure engages the seal roll 32, the draw rolls are stopped and of course feeding of the web material is interrupted. On severing and sealing of the web by the seal bar structure 30, the bag produced is received by a conveyor 34, including an oscillating pick-off 36 located adjacent the seal bar structure. The bag is discharged by the conveyor 34 to a stacking table 38 which may include a plurality of stops or fences 40 for accumulating the bags in a stack.

Figure 3:
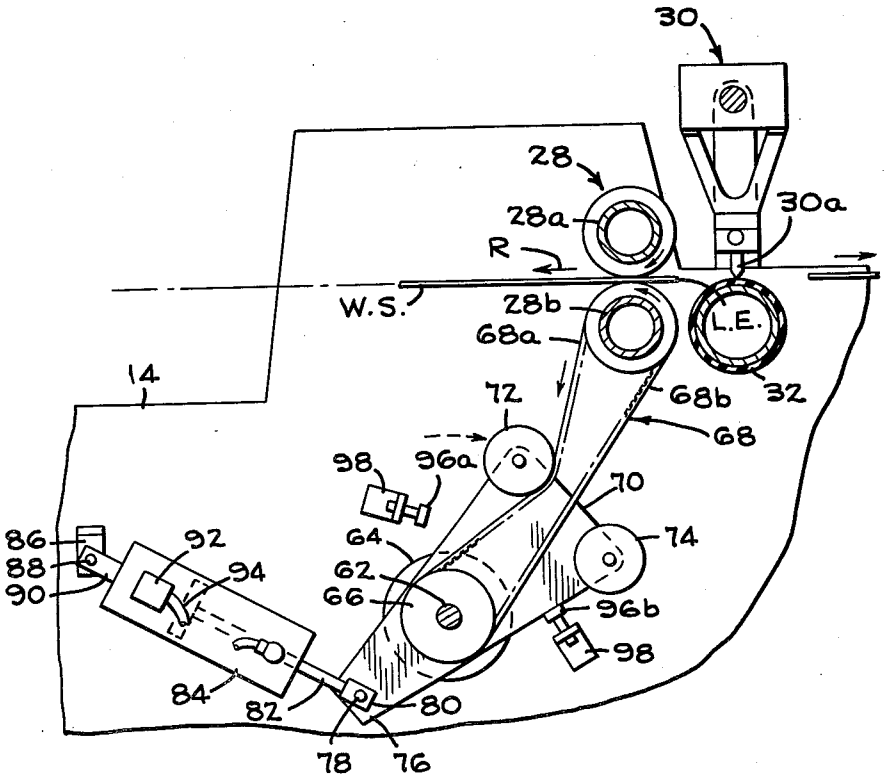
FIGS. 2 and 3 are enlarged fragmentary side elevations of the draw roll reversal mechanism showing, respectively, the position of the draw roll reversal mechanism during normal intermittent operation of the draw rolls and the position assumed in reversing the draw rolls when web feeding is interrupted.

Only those components of the bag machine drive which are necessary for describing the operation of the present invention will be explained. With reference to FIG. 1 a conventional electric motor 42, by means of a belt and pulley arrangement 44, drives a main shaft 46. One revolution of shaft 46 corresponds to one bag making cycle. A disc or plate 48 is keyed on one end of the shaft 46 and it is provided with a pin rotatably mounting one end of a crank 50 whose other end is pinned to a a segment gear 52 pivoted at 54. By virtue of this arrangement each revolution of the main shaft 46 effects one complete oscillation of the segment gear 52. The segment gear is in meshing engagement with a pinion 56 that may be integral with or fixed to another gear 58 meshing with a gear 60 mounted on a transverse shaft, sometimes hereinafter referred to as a clutch brake shaft, 62. Mounting the clutch brake on shaft 62 requires the shaft to be made in two segments. One segment being connected to the clutch and the other to the brake so that the output can be connected, when and as desired, to trasmit torque from the input to the output. The clutch brake on the shaft 62 is designated by the numeral 64 and, as it will be explained in connection with FIGS. 2 and 3, intermittent rotation of the draw rolls is effected.

In accordance with one aspect of the present invention means, preferably in the form of idler pulleys, are provided for imparting tension to the driving reach or the return reach of a belt or chain interconnecting the output of the shaft 62 to the draw rolls. The upper draw roll of the draw rolls is identified as 28*a* and the lower draw roll as 28*b*. The web strip W.S, unwound from the roll of thermoplastic web material 24, is located between the draw rolls 28 which, for purposes of properly feeding the web strip, are adjusted to forceable engage the web strip. The lower draw roll 28*b* and a pulley 66 keyed to shaft 62 are drivingly connected by a timing belt 68 having a return reach 68*a* and a driving reach 68*b*.

Freely rotatably mounted on shaft 62 is a generally triangularly shaped plate 70 on which is rotatably mounted opposed idler wheels 72 and 74 in frictional engagement, respectively, with the return reach 68*a* and the driving reach 68*b*. The plate defines a lug portion 76 mounting a pin 78 received by a small block 80 that is rigidly attached to the end of a rod 82 of a pneumatic actuator 84. The head end of the actuator is connected to a fixed bracket 86 by a pin 88 attached to a link 90.

The actuator 84 is connected to a source of pressure fluid by a conduit 94. Retraction or extension is controlled by a control circuit that, on command from a signal, operates a solenoid 92 admitting pressure fluid to the rod end or the head end of the actuator.

Figure 2:
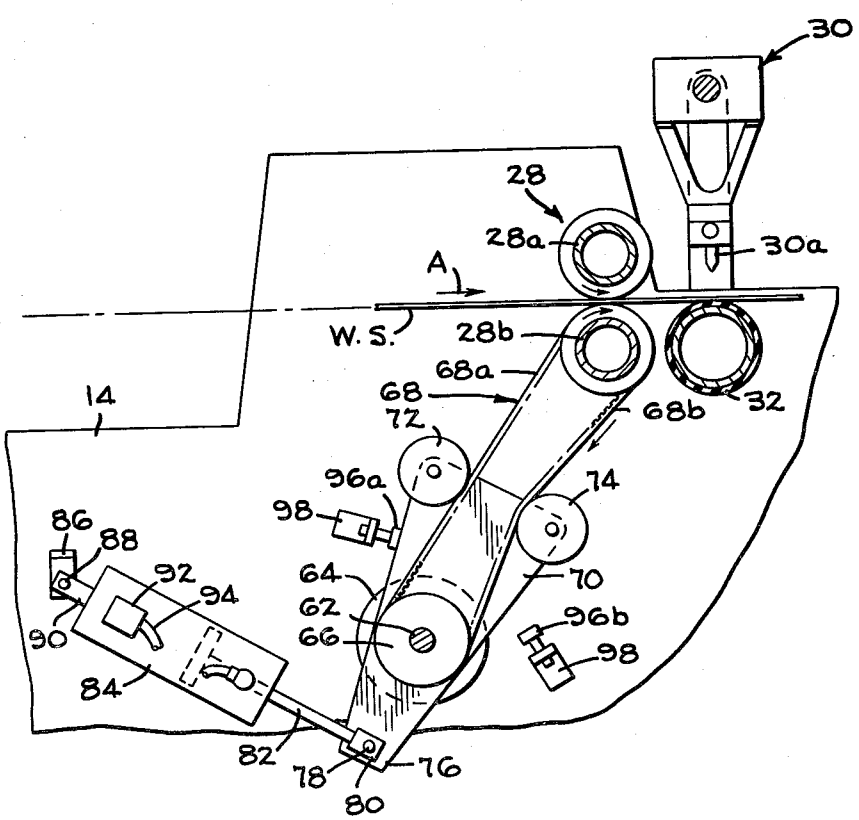

The triangular plate 70, which is pivotally mounted on the shaft 62, is associated with stops 96*a* and 96*b* which may take the form of a threaded rod attached to brackets 98 fixed in any suitable manner to the frame of the machine. When the actuator 84 is extended the triangular plate 70 is forceably urged against the stop 96*a* and accordingly the idler wheels 72 and 74 are both in frictional contact with the timing belt 68 as shown in FIG. 2. In this adjusted position successive intermitent rotation of the draw rolls 28 occurs. When it is desired to arrest the draw rolls 28 for one or more bag machine cycles, or for an indeterminate period of time as determined by the operator, the actuator 84 is retracted causing the plate 70 to be pivoted in a clock-wise direction until the edge of the plate encounters the stop 96*b*. Under these circumstances, the idler roll 72 deflects the return reach 68*a* of the timing belt 68 and the idler roller 74 comes out of contact with the driving reach 68*b*. The embodiment provides that when desired, rollers 72 and 74, and stops 96*a*. and 96*b*. can be adjusted such that roller 74 remains in contact with driving reach 68*b*. when roller 72 has deflected return reach 68*a*. of timing belt 68. Since the shaft 62 is restrained from any movement by virtue of the fact that the brake of the clutch brake 64 is energized, the deflection of the return reach 68*a* causes the draw rolls 28 to rotate to a limited extent in a direction opposite to the direction of web feed which is indicated by the arrow R. The seal bar structure 30, which includes a heated web sealing and severing bar 30*a* continues its reciprocation and its repeated contact with the seal roll 32 while the leading edge of the web strip, identified as L.E., is retracted to the extent determined by the increment of reverse rotation of the draw rolls 28. Before intermittent advance of the web occurs the plate 70 is pivoted against the stop 96*a* to thereby advance the leading edge L.E. to reassume its location under the bar 30.

While the web strip W.S. is retracted during interruption, the seal bar structure continues its normal reciprocation including repeated pressure engagement with the underlying seal roll 32.

By virtue of the above described invention it is now possible to effect interruption of web movement within 260° of a bag machine cycle whereas the most pertinent prior art allows only from 40° to 140° of a cycle. At higher cycle speed of operation the increment of time available for performing the interrupt becomes critical.

Although the best mode contemplated for carrying out the present invention has been herein shown and described, it will be apparent that modification and variation may be made without departing from what is regarded to be the subject matter of the invention.

What I claim is:

1. A thermoplastic bag making machine for operation on a supply roll of thermoplastic web which is unwound and a selected portion thereof being fed, by intermittently rotating draw rolls, to a heated reciprocating bar operable, in cooperation with an underlying rotatable seal roll, to sever and seal the web and thereby produce, from the selected portion of the web fed by the draw rolls, a bag of desired dimensions, said draw rolls continue their intermittent rotation for a preselected number of machine cycles and are thereupon interrupted and rotated in the direction opposite to the web feed direction to, respectively arrest web feeding and retract the leading edge of the web away from the reciprocating heated bar;

the improvement in apparatus for rotating the draw rolls in the opposite direction comprising an endless flexible tension member, being connected to the bag machine drive train, for rotating said draw rolls;

means engageable with a selected reach of said tension member, for increasing the tension of said tension member;

and means, responsive to the selected number of machine cycles or at the command of the operator, for operating said tension increasing means to effect rotation of said draw rolls in said opposite direction and thus retract the leading edge of the web from the plane in which said heated bar reciprocates.

2. The bag making machine of claim 1 wherein said tension member which includes a driving reach and a return reach cooperates with an automatic or selectively operable deflecting member engaging the return reach to effect deflection thereof and produce limited reverse rotation of the device driven thereby.

3. The bag making machine of claim 2 wherein said deflecting member comprises at least one roller translatable toward and away from said return reach.

4. The bag machine according to claim 1 wherein said tensioning means comprises a support, said tensioning means being mounted on said support, means moving said support in a direction that applies increased tension to said tension member, said increased tension being effective to rotate said draw rolls in said opposite direction.

5. The bag machine according to claim 1 wherein said tensioning means comprises rollers in engagement with the driving and the return reach of said tension member when the draw rolls are operating to intermittently feed the web to said heated bar, means rotatably mounting said rollers, said tension operating means when operated to effect rotation of said draw rolls in the direction opposite to said feed direction concurrently moves both rollers so that the return reach is deflected by one of the rollers and the other roller comes out of contact with said tension member.

6. The bag machine according to claim 4 wherein means are provided for limiting movement of said support.

7. The bag machine according to claim 4 wherein said support comprises a generally triangular plate freely rotatably mounting spaced rolls engageable with the driving and return reach of said tension member, said support being mounted for pivotal movement with such movement being limited by stop members, said support, on operation of said tension operating means, being pivoted to forceably engage and deflect said return reach of said tension member to thereby effect limited reverse rotation of said draw rolls and thus effect retraction of the leading edge of the web.

8. The bag machine according to claim 1 wherein said tension operating means comprises a linear actuator, and a moveable support operated by said actuator and mounting at least one roller engageable with said selected reach.

9. The bag machine according to claim 1 wherein said means responsive to the selected number of machine cycles or at the command of the operator, includes control means for sequentially returning said tension increasing means and the retracted leading edge of the web to the point of origin, upon resumption of bag production.

10. An apparatus for preventing heat damage to thermoplastic web converted to produce a package comprising opposed intermittently rotating feed rolls to feed successive web increments; means, longitudinally adjacent said rolls, for sealing and severing the web when said rolls are momentarily at rest; means, including flexible tension member interconnecting a driving and a driven pulley, for connecting said rolls to an intermittently driven shaft; idler rolls in rolling contact with the driving and the return reach of said flexible tension member; said idler rolls being mounted on stub shafts rigidly connected to a moveable support; means, responsive to a selected number of machine cycles or at the command of the operator, for moving said moveable support so that the idler roll in contact with the return reach of said flexible member causes deflection of said reach and effects reversed rotation of said opposed rolls to thereby retract the leading edge of the web away from said sealing and severing means.

11. In a machine for making thermoplastic bags comprising a pair of opposed rolls mounted to provide nip pressure to a web of thermoplastic material which is located between said rolls; means, including an oscillating segment gear and a shaft intermittently rotated by a clutch brake, for rotating one of said opposed rolls to thereby feed increments of said web; said roll rotating means comprising a pulley keyed to said intermittently rotating shaft; a pulley keyed to the shaft of one of said opposed rolls; and a belt interconnecting said pulleys; a flat plate freely mounted on said intermittently rotating shaft, said plate being located in a plane normal to said shaft and adjacent said belt, a fluid actuator having its projecting rod pivotally connected to said plate along an axis spaced from and parallel to the axis of said intermittently rotating shaft and its head end pivotally connected to a stationary support; spaced apart idler wheels rotatably mounted on said flat plate, said wheels being in frictional engagement with the driving and return reach of said belt; stationary abutments located to engage and position said plate in one of two positions, said plate being engageable with one or the other abutments on extension or retraction of the rod of said actuator, said machine including a reciprocating heated bar cooperating with an underlying platen roll, said bar being operative to sever and seal web segments fed by said opposed rolls and thus produce a bag, said machine, after a selected number of bags have been produced, being operative to momentarily suspend operation of said heated bar and said opposed rolls and thus interrupt bag production, said plate, during normal machine operation, being positioned by said actuator so that each wheel is in frictional rolling engagement with the driving and return reach of said belt whereas when operation is momentarily suspended said actuator is concurrently operated to pivot said plate to cause the wheel in contact with the return reach of said belt to deflect such reach and locate the other wheel out of contact with the driving reach, whereupon deflection of said return reach causes said opposed rollers to rotate a limited amount in a direction opposite to the direction in which said web is fed by said opposed rolls and thereby retract the leading edge of the web away from said heated sealing and severing bar.

* * * * *